United States Patent [19]

Zambrow

[11] 4,347,895

[45] Sep. 7, 1982

[54] HEAT EXCHANGER WITH BILAYERED METAL END CONTAINER FOR ANTICORROSIVE ADDITION

[75] Inventor: John L. Zambrow, Lincolnshire, Ill.

[73] Assignee: Borg-Warner Corporation, Chicago, Ill.

[21] Appl. No.: 222,413

[22] Filed: Jan. 5, 1981

[51] Int. Cl.[3] ..... F28F 19/00

[52] U.S. Cl. ..... 165/134 R; 220/455; 428/654; 222/54

[58] Field of Search ..... 428/654, 934, 938; 222/54; 220/453, 455; 165/133, 134 R

[56] References Cited

U.S. PATENT DOCUMENTS

| | | | |
|---|---|---|---|
| 2,726,436 | 12/1955 | Champion | 428/654 |
| 2,797,174 | 6/1957 | Mozley et al. | 428/654 |
| 2,995,808 | 8/1961 | Weisse | 428/654 |
| 3,388,987 | 6/1968 | Bailey | 75/140 |
| 3,393,446 | 7/1968 | Hughes et al. | 428/652 |
| 3,496,621 | 2/1970 | Winter | 428/651 |
| 3,717,915 | 2/1973 | Teubler et al. | 428/654 |
| 3,857,973 | 12/1974 | McKee et al. | 428/654 |
| 3,963,143 | 6/1976 | Anderson et al. | 428/654 |
| 4,197,360 | 4/1980 | Throop | 428/651 |
| 4,244,756 | 1/1981 | Tanabe et al. | 75/140 |

FOREIGN PATENT DOCUMENTS

| | | | |
|---|---|---|---|
| 897615 | 4/1972 | Canada | 220/DIG. 30 |
| 873341 | 4/1953 | Fed. Rep. of Germany | . |
| 522575 | 6/1940 | United Kingdom | 165/134 R |

*Primary Examiner*—Michael L. Lewis
*Attorney, Agent, or Firm*—James A. Geppert

[57] ABSTRACT

A membrane for the end surface of a container housing a corrosion inhibitor for engine coolant where the membrane is exposed to the coolant and corrodes when the corrosiveness of the coolant increases above a predetermined level. The membrane is formed of substantially the same metal or alloy as the radiator and has a thin layer thereon of a second metal so that in a corrosive environment, a galvanic cell is set up between the two metals to enhance the rate of corrosion of the membrane.

6 Claims, 3 Drawing Figures

HEAT EXCHANGER WITH BILAYERED METAL END CONTAINER FOR ANTICORROSIVE ADDITION

BACKGROUND OF THE INVENTION

Engine coolants for the cooling system of an automotive vehicle generally contain ethylene glycol, alone or with a small percentage of diethylene glycol, and a suitable corrosion inhibitor. These inhibitors are usually a mixture of one or more inorganic salts, such as phosphates, borates, nitrates, nitrites, silicates or arsenates, and an organic compound, such as benzotriazole, tolyltriazole or mercaptobenzothiozole, to prevent copper corrosion. Similar inhibitors would be utilized where aluminum corrosion could be a problem. The solution is generally buffered to a pH of 8 to 10 to reduce iron corrosion and to neutralize any glycolic acid formed in the oxidation of ethylene glycol.

Over a period of time, the corrosion inhibitor in the coolant may be lost or at least decreased in concentration due to leakage, hose breakage or boil over, or the inhibitor may decrease in effectiveness due to age. If the corrosion inhibitor in the coolant decreases, metal corrosion will increase significantly. This is especially true for higher temperature coolant systems or where new lightweight aluminum radiators are substituted for conventional copper brass radiators.

In the copending U.S. patent application Ser. No. 88,506 filed Oct. 26, 1979, a container is disclosed which was suitably secured in a coolant line to the radiator with a corrodible end wall exposed to the coolant flowing through the line so that, if the coolant became corrosive, the end of the container would corrode through to release corrosion inhibitor in the container into the coolant stream to reduce the corrosiveness of the coolant before corrosion of the radiator became a problem. For an aluminum radiator, the end wall of the container was formed of aluminum or an aluminum alloy, and the wall surface exposed to the coolant was scored or knurled to enhance localized corrosion.

However, although the end surface of the container will pit and corrode to allow liquid to enter and dissolve the corrosion inhibitor prior to serious corrosion of the radiator or other components of the cooling system, it would be desirable to speed up the corrosion process of the container surface to shorten the time interval between the coolant reaching the predetermined corrosive level and the point when the corrosion inhibitor is effectively released into the coolant. The present invention provides a container membrane which will act to shorten that time interval.

SUMMARY OF THE INVENTION

The present invention comprehends the provision of a corrosion inhibitor container having a membrane that is susceptible to corrosion due to the corrosive level of the coolant contacting the membrane wherein, once corrosion of the membrane is initiated, the membrane corrodes rapidly from a resulting galvanic couple. The membrane is formed of a base layer of substantially the same material as the radiator to be protected from corrosion, and the base material is coated with a film of a second material. Once the base material begins to corrode, the second material acts with the base material as a galvanic couple to enhance the rate of corrosion of the membrane.

The present invention also comprehends the provision of a novel membrane for a corrosion inhibitor container comprising an aluminum alloy base material coated with a thin layer of very pure aluminum. The coating is an imperforate layer to protect the base layer until the coolant becomes corrosive, at which point the pure aluminum film is pierced to initiate corrosion of the aluminum alloy, and the aluminum alloy base material with the pure aluminum coating results in a galvanic couple to speed up corrosion.

Further objects are to provide a construction of maximum simplicity, efficiency, ecomony and ease of assembly and operation, and such further objects, advantages and capabilities as will later more fully appear and are inherently possessed thereby.

DESCRIPTION OF THE PREFERRED EMBODIMENT

Figure 1:
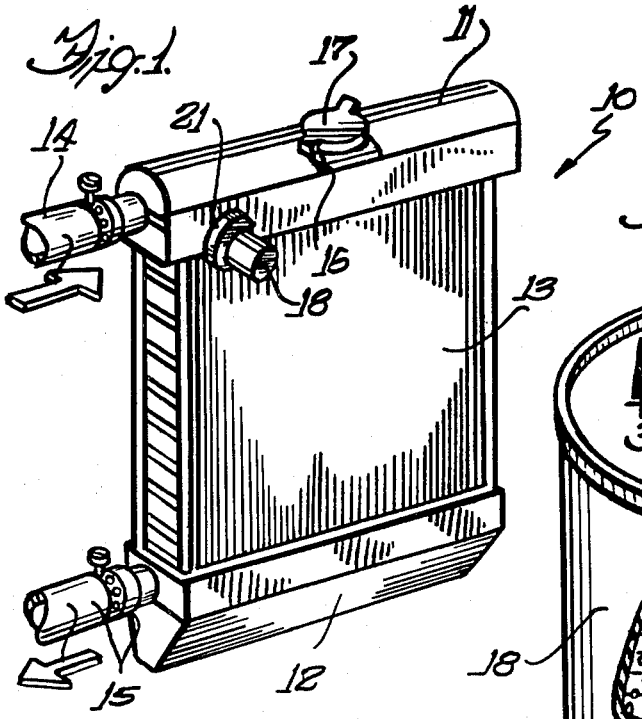
FIG. 1 is a perspective view of an automobile radiator with a corrosion inhibitor container positioned thereon.
Figure 2:
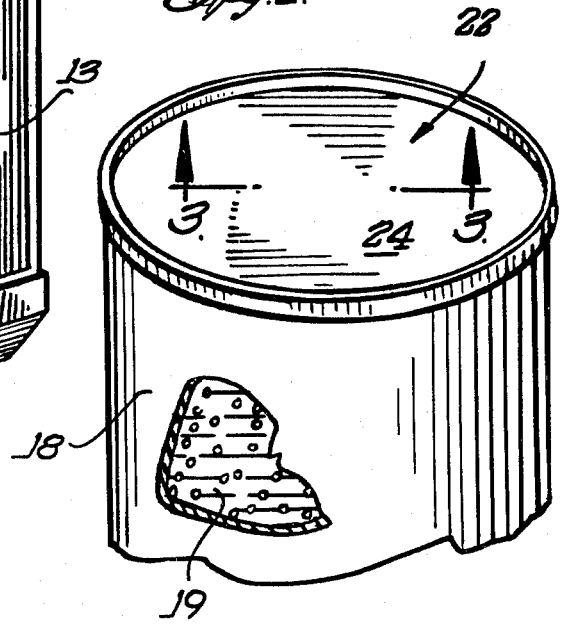
FIG. 2 is a partial perspective view of the corrosion inhibitor container with the novel membrane end surface.
Figure 3:
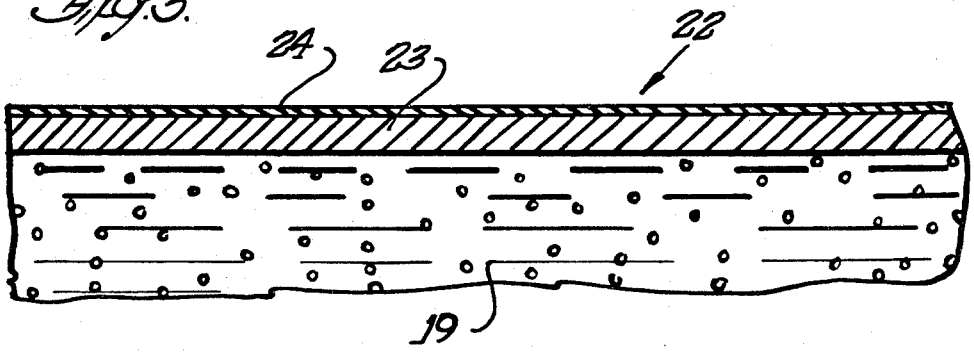
FIG. 3 is a partial cross sectional view through the membrane taken on the like 3—3 of FIG. 2.

Referring more particularly to the disclosure in the drawing wherein is shown an illustrative embodiment of the present invention, FIG. 1 discloses the radiator portion of an automotive vehicle cooling system including a radiator 10 having an inlet tank 11, an outlet tank 12 and a heat transfer core 13. A coolant inlet line 14 is connected to the tank 11, an outlet line 15 is connected to the tank 12, and a filler neck 16 communicates with tank 12 and has a pressure relief cap 17 to vent excess pressure to a suitable overflow (not shown).

Coolant comprising a mixture of ethylene glycol and water with a suitable corrosion inhibitor is circulated through the vehicle engine cooling system, wherein hot coolant from the vehicle engine cooling jacket flows through the inlet line 14 into the inlet tank 11, passes down through the radiator core 13 to be cooled by air flowing transversely through the core, and the cooled fluid exits from the outlet tank 12 through the outlet line 15 to the coolant pump (not shown) which forces the coolant back into the engine cooling jacket.

If the corrosion inhibitor concentration in the coolant should decrease below a predetermined level due to leakage or boiling over of the coolant or aging of the inhibitor, a container 18 filled with a charge of corrosion inhibitor 19 is suitably mounted in a fitting 21 on the side of the inlet tank 11. A membrane 22 seals one end of the container 18 and is exposed through the fitting 21 to the flowing coolant. This membrane is formed of a material similar to the material of the radiator 10, such that the corrosive quality of the coolant will act to corrode the membrane to allow release of the inhibitor in the container prior to any serious corrosion of the radiator. As disclosed in U.S. patent application Ser. No. 88,506, the membrane is formed of aluminum or an aluminum alloy when the radiator 10 is formed of aluminum.

Although this membrane is relatively thin so that it can be pierced to release the corrosion inhibitor 19 before any permanent corrosion damage is caused to the susceptible components of the coolant system, it must be strong enough to withstand the mechanical forces imposed on it by pressure and temperature changes, and by mechanical shock or fatigue. Thus, although the aluminum foil membrane is effective for the intended purpose, it is desirable to speed up corrosion of the membrane under corrosive conditions to more quickly release the inhibitor into the coolant. To achieve this more rapid release, the membrane is formed as a bimetal.

The bimetallic membrane has a base metal layer 23 of an aluminum alloy, such as 2024 aluminum, and a thin imperforate film 24 of pure aluminum is coated on the surface of layer 23 in contact with the aqueous coolant, such as by sputtering or ion plating. The base layer 23 is over 0.005 inches thick while the coating thickness is in the range of 5 to 100 microinches; just thick enough to provide corrosion protecting as long as the coolant contains sufficient inhibitor. If the inhibitor concentration falls below the required level, the thin aluminum film is quickly pierced exposing the corrodible base metal 23. The corrodible base metal is then quickly penetrated to release the fresh inhibitor.

Inhibitor release from the container 18 should be as rapid as possible in corrosive fluid so long as no corrosion occurs in the presence of inhibited ethylene glycol-water mixture. In addition, release should not be blocked by corrosive aluminum oxide formation. The sputter deposited film decreases the penetration time (because it is so thin) thus exposing the aluminum alloy membrane to the corrosive fluid, with corrosion being accelerated through the galvanic action of the aluminum-aluminum alloy couple.

I claim:

1. A heat exchanger in combination with a container for the automatic addition of a corrosion inhibitor into a circulating fluid system for the heat exchanger subject to corrosion, including a container housing the corrosion inhibitor with a membrane for one end of said container having an exterior surface exposed to the circulating fluid, said container end comprising a bimetallic membrane having a base metal layer forming the interior surface exposed to the corrosion inhibitor and which will corrode when the circulating fluid has an unacceptable level of corrosion inhibitor, and an imperforate thin film of a second metal formed on the exterior surface of the base layer to protect the base layer until a corrosive condition occurs.

2. A membrane as set forth in claim 1, in which the base metal is an easily corrodible aluminum alloy and the second layer is a film of substantially pure aluminum.

3. A membrane as set forth in claim 2, in which the pure aluminum film acts to protect the aluminum alloy when the corrosion inhibitor concentration is above a predetermined level, but will be easily penetrated when the inhibitor concentration decreases below said level.

4. A membrane as set forth in claim 2, in which said aluminum alloy base metal and pure aluminum film result in a galvanic couple once the film is penetrated under corrosive conditions.

5. A membrane as set forth in claim 2, in which said aluminum film is deposited on said aluminum alloy base by sputter coating or ion plating.

6. A membrane as set forth in claim 2, in which the base metal layer has a thickness of at least 0.005 inches and the thin film has a thickness in the range of 5 to 100 microinches.

* * * * *